US010516230B2

(12) United States Patent
Kot et al.

(10) Patent No.: US 10,516,230 B2
(45) Date of Patent: Dec. 24, 2019

(54) ELECTRICAL CONNECTOR ASSEMBLY

(71) Applicant: Delphi Technologies, LLC, Troy, MI (US)

(72) Inventors: Lukasz Kot, Suloszowa (PL); Michal Grudzewski, Cracow (PL)

(73) Assignee: Delphi Technologies, LLC, Troy, IA (US)

( * ) Notice: Subject to any disclaimer, the term of this patent is extended or adjusted under 35 U.S.C. 154(b) by 0 days.

(21) Appl. No.: 15/920,033

(22) Filed: Mar. 13, 2018

(65) Prior Publication Data

US 2018/0269616 A1 Sep. 20, 2018

(30) Foreign Application Priority Data

Mar. 17, 2017 (EP) ..... 17161625

(51) Int. Cl.
*H01R 13/436* (2006.01)
*H01R 13/506* (2006.01)
*H01R 13/58* (2006.01)

(52) U.S. Cl.
CPC ..... *H01R 13/4361* (2013.01); *H01R 13/506* (2013.01); *H01R 13/582* (2013.01); *H01R 13/5816* (2013.01)

(58) Field of Classification Search
CPC ..... H01R 13/5804; H01R 13/5812; H01R 13/5816; H01R 13/5825; H01R 13/4361
USPC ..... 439/465, 469, 460, 468
See application file for complete search history.

(56) References Cited

U.S. PATENT DOCUMENTS 4,195,899 A * 4/1980 Radloff ..... H01R 13/5812 439/468
4,358,178 A * 11/1982 Guy ..... H01R 13/516 439/464
5,211,706 A * 5/1993 Polgar ..... H01R 13/506 439/464
5,244,415 A * 9/1993 Marsilio ..... H01R 9/032 439/456
7,014,498 B1 * 3/2006 Munoz ..... H01R 13/5025 439/352
7,527,520 B2 * 5/2009 Nitobe ..... H01R 13/5812 439/464
8,772,641 B2 7/2014 Badura et al.
(Continued)

FOREIGN PATENT DOCUMENTS

EP 2590271 A1 5/2013
GB 2518076 A 3/2015
JP 2012119241 A 6/2012

*Primary Examiner* — Tulsidas C Patel
*Assistant Examiner* — Marcus E Harcum
(74) *Attorney, Agent, or Firm* — Robert J. Myers

(57) ABSTRACT

An electrical connector assembly includes a housing having cavities for receiving electric contact elements and a fastening device to fasten a cable harness that includes the electrical contact elements. The electrical connector assembly also includes a cover attached to the housing. A housing transition portion of the housing and a cover transition portion of the cover cooperate with each other to define a tube shaped guiding channel for guiding the cable harness. The fastening device is arranged inside the guiding channel. The fastening device comprises means configured to cooperate with a cable tie such that it guides and holds the cable tie in a holding direction perpendicular to an extension direction of the guiding channel.

13 Claims, 6 Drawing Sheets

(56) References Cited

U.S. PATENT DOCUMENTS

| | | | | |
|---|---|---|---|---|
| 9,466,960 | B2 * | 10/2016 | Takeuchi | B60R 16/0215 |
| 9,537,249 | B2 * | 1/2017 | Grudzewski | H01R 13/502 |
| 2002/0055299 | A1 | 5/2002 | Zweigle | |
| 2005/0003699 | A1 * | 1/2005 | Fukui | H01R 13/562<br>439/473 |
| 2007/0193002 | A1 | 8/2007 | Nitobe | |
| 2008/0280467 | A1 * | 11/2008 | Tsuji | H01R 13/4223<br>439/135 |
| 2014/0080351 | A1 * | 3/2014 | Kawakami | H01R 13/5804<br>439/464 |
| 2015/0280358 | A1 * | 10/2015 | Wiedemann | H01R 13/5804<br>439/460 |
| 2017/0085067 | A1 * | 3/2017 | Sugimoto | H01R 13/5812 |

* cited by examiner

ELECTRICAL CONNECTOR ASSEMBLY

CROSS-REFERENCE TO RELATED APPLICATION

This application claims the benefit under 35 U.S.C. § 119(a) of Patent Application No. 17161625.3 filed in the European Patent Office on Mar. 17, 2017, the entire disclosure of which is hereby incorporated by reference.

TECHNICAL FIELD OF THE INVENTION

The invention generally relates to an electrical connector assembly for establishing a detachable electric plug-and-socket connection with another connector, including a housing in which electric contact elements are arranged, and a cover to protect the contact elements, as well as a fastening device for fastening a cable harness leading to the contact elements to the electrical connector assembly.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
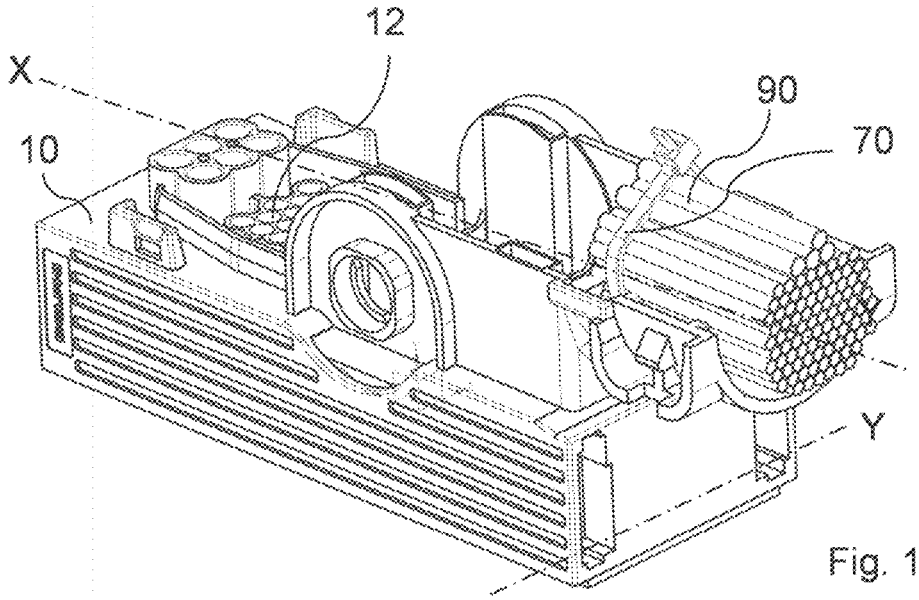
FIG. 1 shows a schematic view of the housing with an attached cable harness portion in accordance with one embodiment.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

A non-limiting example of an electrical junction box for a vehicle is presented herein. The electrical junction box includes a plurality of relays, a relay carrier, and a lead frame including connecting sections, each relay including electrical connection pins enabling the relay to be plugged into the relay carrier and enabling electrical connection to the lead frame. Each relay includes a communication bus interface that is connected to a pin, termed control pin, of the relay. The lead frame includes a section forming a communication bus, the control pins of the relays being connected electrically to the section forming a communication bus when the relays are plugged into the carrier.

The section forming a communication bus makes it possible to dispense with the use of a printed circuit board as an electronic carrier for the bus. The use of relays specifically including a communication bus interface, and the use of a section of the lead frame as a communication bus, makes it possible to dispense with a plurality of independent sections for individually controlling each relay. Specifically, the communication bus formed by a section of the lead frame makes it possible to provide a control section that is common to all of the relays, the communication bus enabling each controlled relay to be addressed individually.

The section forming a communication bus may be coupled electrically to an electrical ground section of the lead frame so as to form an electrical capacitor. The section forming a communication bus may have a thickness smaller than the other sections. The relay may include an electromechanical switch provided to enable the flow of electric current distributed to the electrical loads of the vehicle, or a semiconductor switch provided to enable the flow of electric current distributed to the electrical loads of the vehicle.

The communication bus may be of Local Interconnect Network (LIN) type. The lead frame may include another section forming a differential pair transmission bus with the section forming a communication bus, another control pin of the relay being connected electrically to the other section forming a differential pair transmission bus. The electrical junction box may additionally include an electrical connection strip towards the outside of the box, the strip being connected electrically to the section forming a communication bus.

An electric current distribution system for a vehicle may include a control housing equipped with a microcontroller, and an electrical junction box such as described above. The control housing may include a communication bus interface linked electrically to the section forming a communication bus of the electrical junction box.

FIG. 1 shows a schematic view of the housing 10 with an attached cable harness 90. The cable harness 90 shown in FIG. 1 is just a portion of a complete cable harness. The view is chosen to illustrate how the cable tie 70 is fastened to a fastening device 50 and guided around the cable harness 90, thereby holding the cable harness 90 tightly to the housing 10.

Figure 2:
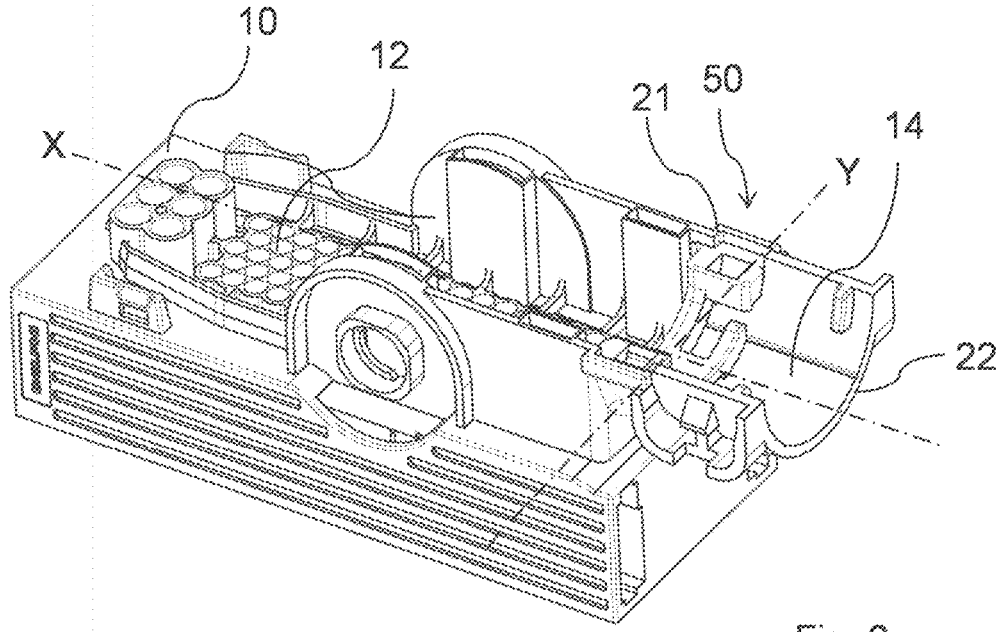
FIG. 2 shows in a perspective view the housing of the electrical connector assembly in accordance with one embodiment.

FIG. 2 shows in a perspective view the housing 10 of the electrical connector assembly 1, including the housing 10 with cavities 12 for receiving electric contact elements and the fastening device 50 to fasten the cable harness 90 that includes the electrical contact elements. The electrical connector assembly 1 furthermore including a cover 100 (FIG. 3) to protect the contact elements. A housing transition portion 14 of the housing 10 and a cover transition portion 114 of the cover 100 cooperate with each other, to define a tube shaped guiding channel 20 for guiding the cable harness 90 through. The fastening device 50 is arranged inside the guiding channel 20. The fastening device 50 includes means configured to cooperate with a cable tie 70 such that it guides and holds the cable tie 70 in a holding direction Y perpendicular to an extension direction X of the guiding channel 20.

Figure 3:
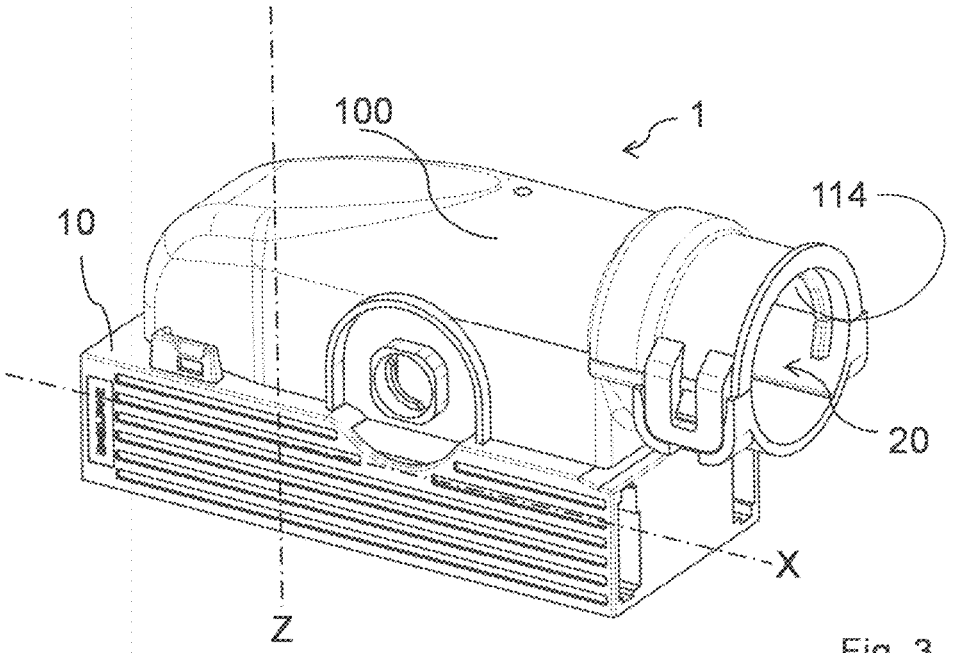
FIG. 3 shows the electrical connector assembly in a perspective view in accordance with one embodiment.

FIG. 3 shows the electrical connector assembly 1 in a perspective view. The cover 100 is attached to the housing 10 the housing transition portion 14 of the housing 10 and a cover transition portion 114 of the cover 100 cooperate with each other, to define the guiding channel 20. The guiding channel 20 is arranged along the extension direction X perpendicular to a mating axis Z.

Figure 4:
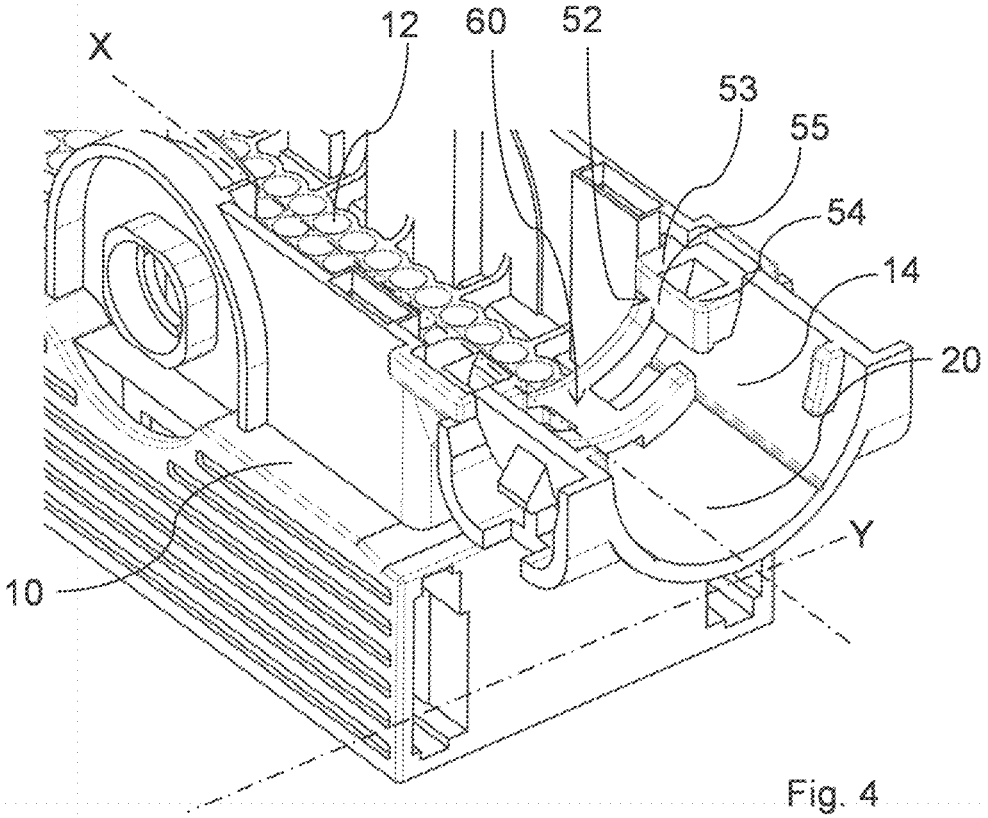
FIG. 4 shows the fastening device of the electrical connector assembly in a perspective view in accordance with one embodiment.

FIG. 4 shows the fastening device 50 of the electrical connector assembly 1 in a perspective view. The fastening device 50 includes a handle 52, including a first protrusion 53 and a second protrusion 54 protruding, spaced apart from each other, by a first distance 56 (FIG. 5) from the housing transition portion 14 into the guiding channel 20. A handle bar 55 connects the free end of the first protrusion 53 and the free end of the second protrusion 54 in a second distance 57 (FIG. 5) from the housing transition portion 14. The first protrusion 53 and the second protrusion 54 are arranged in a row along the extension direction X of the guiding channel 20.

Figure 5:
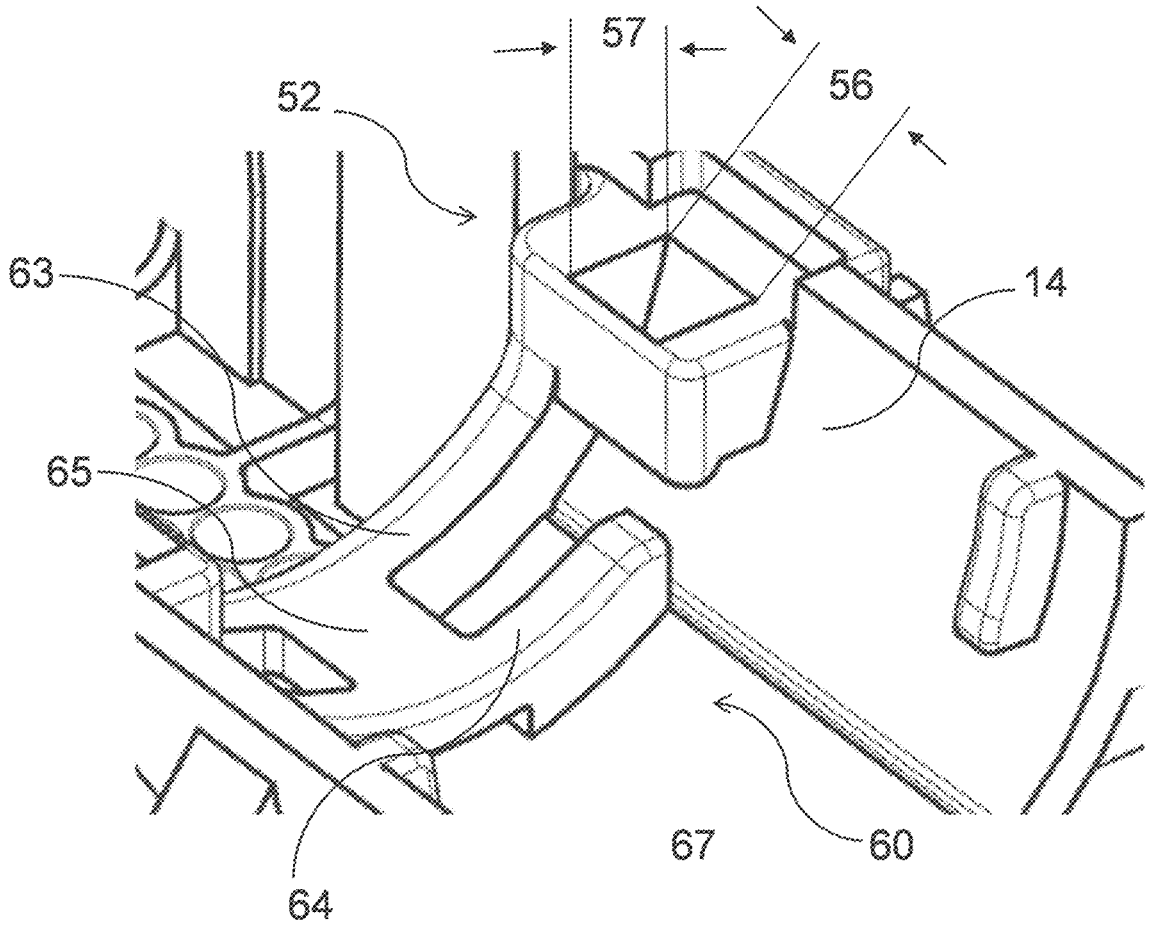
FIG. 5 shows the fastening device of the electrical connector assembly in an enlarged perspective view in accordance with one embodiment.

FIG. 5 shows a more detailed view of the fastening device 50. The fastening device 50 includes at least one channel segment 60, including a first rib 63 and a second rib 64 protruding along the holding direction Y, spaced apart from each other by a third distance 66 (FIG. 6) from the housing transition portion 14 into the guiding channel 20. A rib bar 65 connects a portion of the free end of the first rib 63 and a portion of the free end of the second rib 64 in a fourth distance 67 from the housing transition portion 14, thereby defining a tube shaped portion.

Figure 6:
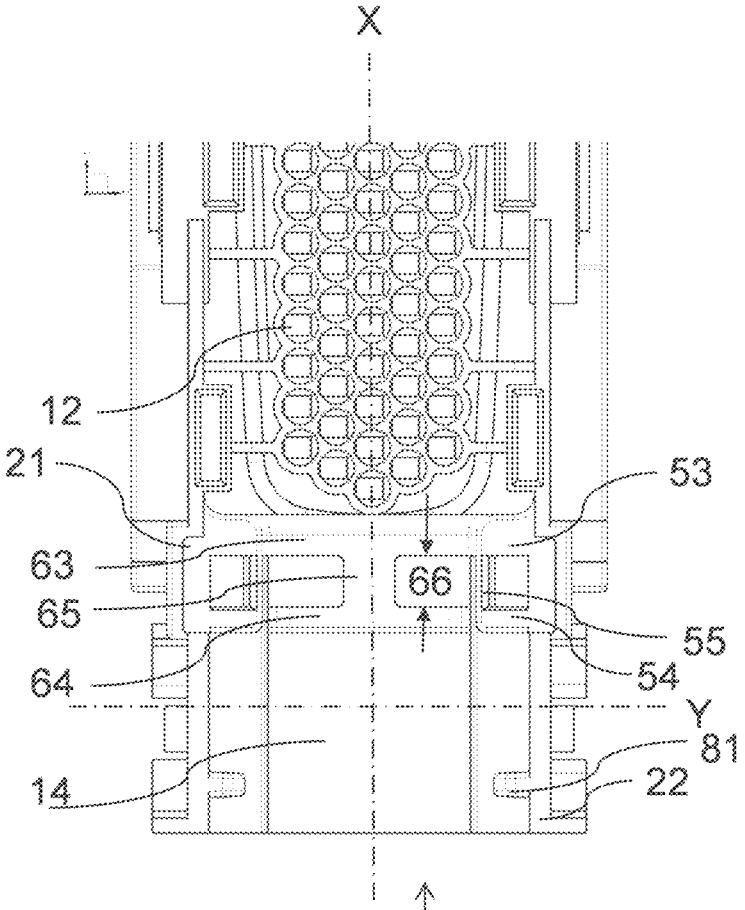
FIG. 6 shows a top view of the housing in accordance with one embodiment.

FIG. 6 shows a top view of the housing 10 wherein the fastening device 50 includes the handle 52 and at least one channel segment 60 arranged in a row along the holding direction Y. The guiding channel 20 includes a channel first end 21 and a channel second end 22, wherein the channel first end 21 is closer to the cavities 12 than the channel second end 22, whereby the fastening device 50 is located at the channel first end 21.

Figure 7:
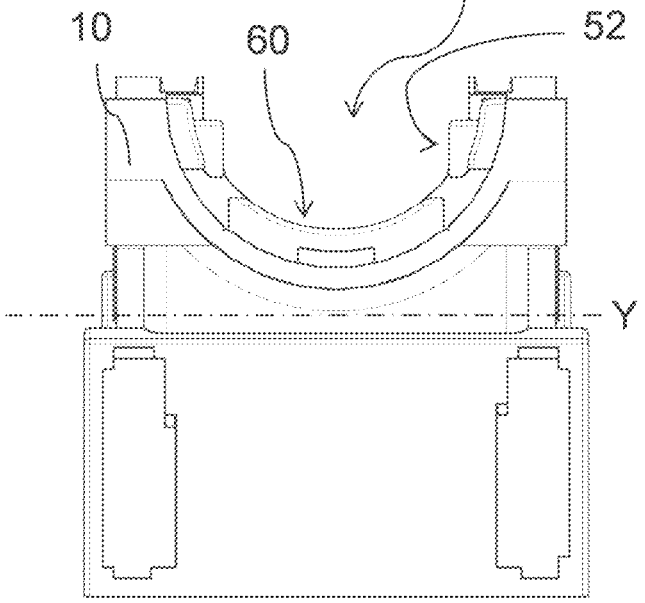
FIG. 7 shows a side view of the of the housing in accordance with one embodiment.

FIG. 7 shows a side view of the housing 10 with a view direction along the holding direction Y, towards the guiding channel 20.

Figure 8:
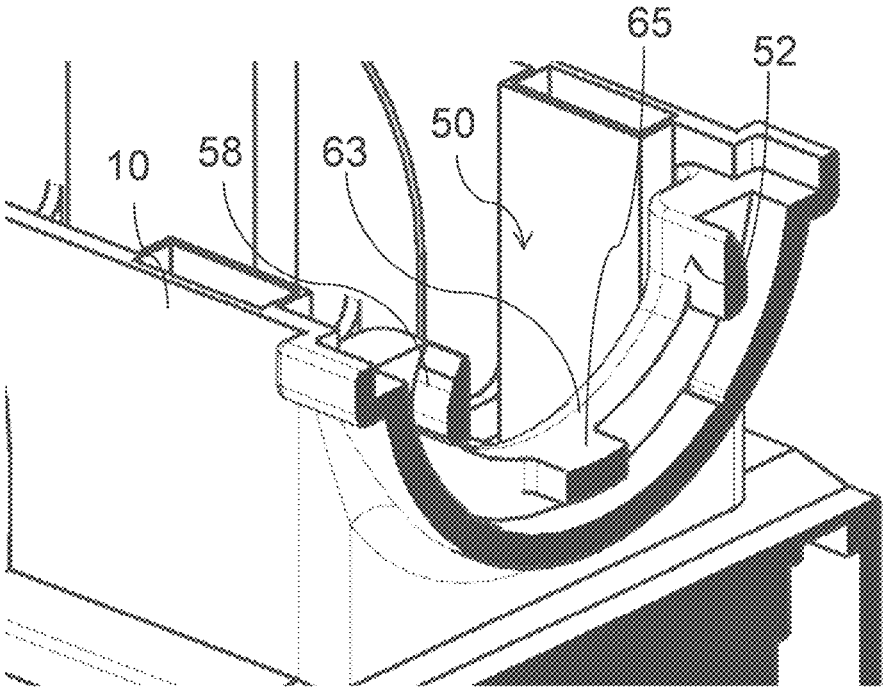
FIG. 8 shows the housing with a cut along the holding direction Y as a perspective view in accordance with one embodiment.

FIG. 8 shows the housing 10 with a cut along the holding direction Y through the fastening device 50, in a perspective view. In this embodiment, the first rib 63 is connected to the handle 52. The handle bar 55 includes a guiding surface 58 located between the first protrusion 53 and the second protrusion 54, whereby the guiding surface 58 is sloped or curved to enlarge the area of the handle 52 where the cable tie 70 is inserted while assembling.

Figure 9:
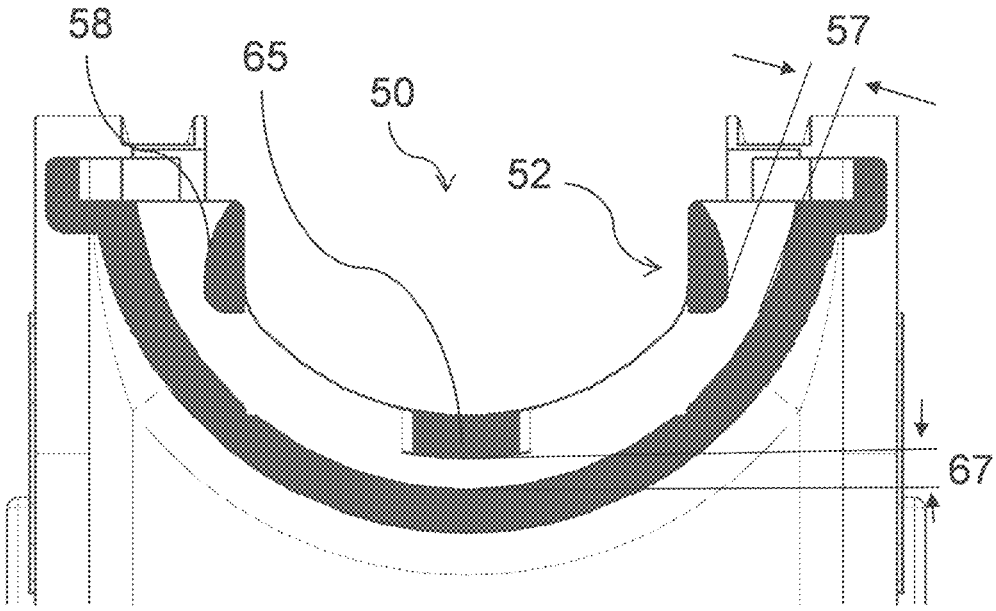
FIG. 9 shows the cut view from FIG. 8 in a planar view in accordance with one embodiment.

FIG. 9 shows the cut view as shown in FIG. 8 now as front view looking in extension direction X. This view shows best the second distance 57 and the fourth distance 67 of the fastening device 50.

Figure 10:
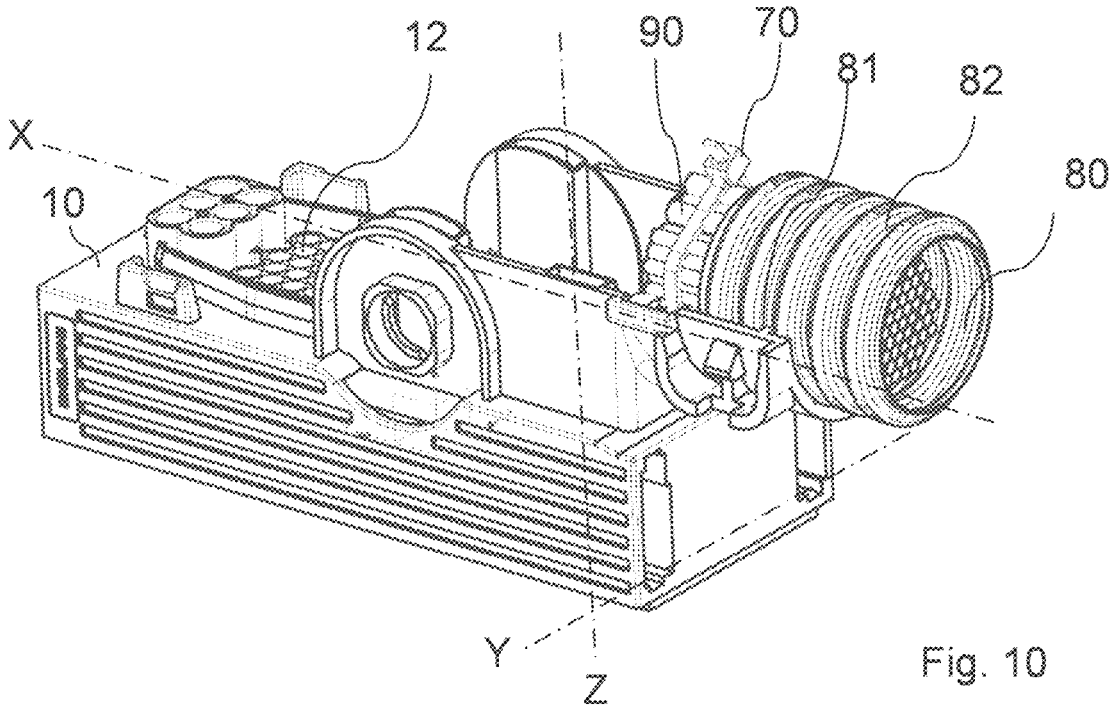
FIG. 10 shows in a perspective view of the housing with an attached corrugated tube in accordance with one embodiment.

FIG. 10 shows in a perspective view of the housing 10 with a fastened cable harness 90 and an attached corrugated tube 80. The guiding channel 20 includes holding means to secure the corrugated tube 80 on the channel second end 22 of the guiding channel 20. The holding means includes a holding rib 81 protruding along the holding direction Y from the housing transition portion 14 into the guiding channel 20, whereby the holding rib 81 cooperates with a narrowing 82 in the corrugated tube 80 to secure the corrugated tube 80.

Figure 11:
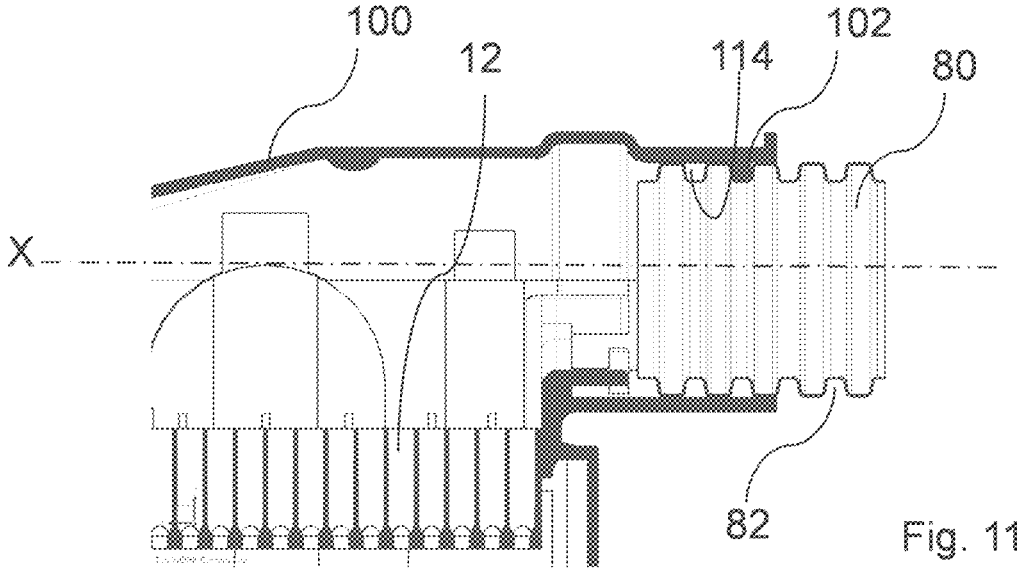
FIG. 11 shows a cut view of the cut view of electrical connector assembly shown in FIG. 3 with a corrugated tube attached in accordance with one embodiment.

FIG. 11 shows a cut view of the illustration shown in FIG. 10 (with a corrugated tube 80 attached but without he cable harness 90) wherein the cut is carried out along the central line of the housing 10. The cover 100 includes on the inner side in the cover transition portion 114 a holding rib 102 that cooperates with a narrowing 82 in the corrugated tube 80.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, directional terms such as upper, lower, etc. do not denote any particular orientation, but rather the terms upper, lower, etc. are used to distinguish one element from another and establish a relationship between the various elements.

We claim:

1. An electrical connector assembly, comprising:

a housing having cavities for receiving electric contact elements and a fastening device to fasten a cable harness that includes the electrical contact elements; and a cover attached to the housing, wherein a housing transition portion of the housing and a cover transition portion of the cover cooperate with each other to define a tube shaped guiding channel for guiding the cable harness, wherein the fastening device is arranged inside the guiding channel, wherein the fastening device comprises means configured to cooperate with a cable tie such that it guides and holds the cable tie in a holding direction perpendicular to an extension direction of the guiding channel, wherein the fastening device comprises a handle having a first protrusion and a second protrusion spaced apart from the first protrusion by a first distance, protruding from the housing transition portion into the guiding channel and wherein a handle bar connects a free end of the first protrusion and a free end of the second protrusion at a second distance from the housing transition portion, wherein the fastening device has a channel segment including a first rib and a second rib protruding along the holding direction, spaced apart from each other by a third distance from the housing transition portion into the guiding channel, and wherein a rib bar connects a portion of the free end of the first rib and a portion of the free end of the second rib in a fourth distance from the housing transition portion, thereby defining a tube shaped portion.

2. The electrical connector assembly according to claim 1, wherein the first distance is corresponds to the cable tie such that the first distance is greater than a width of the cable tie and wherein the second distance corresponds to the cable tie such that the second distance is greater than a height of the cable tie.

3. The electrical connector assembly according to claim 1, wherein the handle bar has a guiding surface located between the first protrusion and the second protrusion, wherein the guiding surface is sloped or curved to enlarge an area of the handle at a location where the cable tie is inserted while assembling.

4. The electrical connector assembly according to claim 1, wherein the first protrusion and the second protrusion are arranged in a row along the extension direction of the guiding channel.

5. The electrical connector assembly according to claim 1, wherein the third distance corresponds to the cable tie such that the third distance is greater than a width of the cable tie and wherein the fourth distance corresponds to the cable tie such that the fourth distance is greater than a height of the cable tie.

6. The electrical connector assembly according to claim 1, wherein the fastening device comprises the handle and the channel segment arranged in a row along the holding direction.

7. The electrical connector assembly according to claim 6, wherein the first distance is greater than the third distance and the second distance is greater than the fourth distance.

8. The electrical connector assembly according to claim 1, wherein the guiding channel comprises a channel first end and a channel second end, wherein the channel first end is closer to the cavities than the channel second end, and wherein the fastening device is located at the channel first end.

9. The electrical connector assembly according to claim 8, wherein the guiding channel comprises holding means for securing a corrugated tube on the channel second end of the guiding channel.

10. The electrical connector assembly according to claim 9, wherein the holding means comprises a holding rib protruding along the holding direction from the housing transition portion into the guiding channel and wherein the holding rib cooperates with a narrowing in the corrugated tube to secure the corrugated tube.

11. The electrical connector assembly according to claim 1, wherein the housing is made in one piece.

12. The electrical connector assembly according to claim 1, wherein the housing is produced by injection molding.

13. An electrical cable harness assembly, comprising;

an electrical connector assembly according to claim 1;

the cable harness;

the electrical contact elements; and the cable tie.

* * * * *